US009318082B2

(12) United States Patent
Dixon

(10) Patent No.: US 9,318,082 B2
(45) Date of Patent: Apr. 19, 2016

(54) LEADPIPE OR MOUTHPIPE SYSTEM FOR TROMBONE OR OTHER BRASS INSTRUMENT

(71) Applicant: THE BOARD OF TRUSTEES OF THE UNIVERSITY OF ILLINOIS, Urbana, IL (US)

(72) Inventor: Matthew Dixon, Champaign, IL (US)

(73) Assignee: The Board of Trustees of the University of Illinois, Urbana, IL (US)

( * ) Notice: Subject to any disclaimer, the term of this patent is extended or adjusted under 35 U.S.C. 154(b) by 5 days.

(21) Appl. No.: 14/177,941

(22) Filed: Feb. 11, 2014

(65) Prior Publication Data

US 2015/0228258 A1 Aug. 13, 2015

(51) Int. Cl.

| | |
|---|---|
| ***G10D 9/02*** | (2006.01) |
| ***G10D 9/00*** | (2006.01) |
| ***G10D 7/00*** | (2006.01) |
| ***G10D 7/10*** | (2006.01) |

(52) U.S. Cl.
CPC .. *G10D 7/10* (2013.01); *G10D 7/00* (2013.01); *G10D 9/00* (2013.01); *G10D 9/02* (2013.01); *G10D 9/026* (2013.01)

(58) Field of Classification Search
CPC ..... G10D 9/026; G10D 9/02
USPC ..... 84/398
See application file for complete search history.

(56) References Cited

U.S. PATENT DOCUMENTS

| | | | | | |
|---|---|---|---|---|---|
| 1,232,069 | A * | 7/1917 | Nelson | G10D 7/10 | 84/394 |
| 2,018,738 | A * | 10/1935 | Parduba | G10D 9/026 | 84/398 |
| 2,302,492 | A * | 11/1942 | Dobie | G10D 9/026 | 84/398 |
| 2,758,497 | A * | 8/1956 | Sarad | G10D 9/026 | 84/399 |
| 2,798,402 | A * | 7/1957 | Zottola | G10D 9/026 | 84/398 |
| 3,370,500 | A * | 2/1968 | Zwolak | G10D 9/026 | 84/398 |
| 3,474,698 | A * | 10/1969 | Anbo | G10D 9/026 | 84/399 |
| 3,543,629 | A * | 12/1970 | Barcus | G10D 7/10 | 84/398 |
| 3,728,929 | A * | 4/1973 | Sanders | G10D 9/026 | 84/398 |
| 3,807,271 | A * | 4/1974 | Nipken | G10D 9/026 | 84/399 |

(Continued)

*Primary Examiner* — David Warren
*Assistant Examiner* — Christina Schreiber
(74) *Attorney, Agent, or Firm* — Greer, Burns & Crain, Ltd.

(57) ABSTRACT

A leadpipe for a musical instrument comprising: a sidewall defining an enclosed channel, the sidewall having an upstream end and a downstream end; wherein the sidewall is comprised of a plurality of sections including a first tapered section and at least one subsequent tapered section; wherein each of the sections extends longitudinally between the upstream end and the downstream end of the sidewall; wherein the first tapered section is disposed upstream of the at least one subsequent tapered sections; wherein the first tapered section and at least one subsequent tapered section of the sidewall each define a generally frustoconical cavity having an upstream inner diameter Df and a downstream inner diameter Ds; and wherein the downstream diameter of each of the tapered sections that defines a generally frustoconical cavity is larger than the upstream diameter. The leadpipe may produce greater intensity of overtones and improved sound quality.

19 Claims, 8 Drawing Sheets

(56) References Cited

U.S. PATENT DOCUMENTS 4,178,830 A * 12/1979 Ramirez ..... G10D 9/00 84/388
4,273,020 A * 6/1981 Happe ..... G10D 7/10 84/387 R
4,559,859 A * 12/1985 Pilczuk ..... G10D 7/10 84/387 R
4,658,697 A * 4/1987 Wean ..... G10D 9/026 84/398
5,847,300 A * 12/1998 Hackl ..... G10D 9/026 84/398
5,969,280 A * 10/1999 Marcinkiewicz ..... G10D 9/026 84/398
6,008,443 A * 12/1999 Honorato Ibanez ... G10D 9/026 84/387 R
6,087,572 A * 7/2000 Dillon ..... G10D 7/10 84/387 R
7,161,077 B1 * 1/2007 Fry ..... G10D 9/04 84/387 R
2002/0066355 A1 * 6/2002 Parkos ..... G10D 9/026 84/398
2011/0126691 A1 * 6/2011 Hartman ..... G10D 9/026 84/398
2012/0234328 A1 * 9/2012 Bertram ..... A61M 16/04 128/207.15
2013/0104723 A1 * 5/2013 Griffin ..... G10D 9/026 84/398
2014/0109748 A1 * 4/2014 Griffin ..... G10D 9/026 84/398
2015/0269919 A1 * 9/2015 Tseng ..... G10D 9/02 84/398

* cited by examiner

LEADPIPE OR MOUTHPIPE SYSTEM FOR TROMBONE OR OTHER BRASS INSTRUMENT

FIELD OF THE INVENTION

The present invention is related to the leadpipe or mouthpipe that forms a conduit for air to travel between a mouthpiece and a body of an instrument and, more particularly, to an improved design of the leadpipe which results in improved sound quality for brass instruments

BACKGROUND OF THE INVENTION

Several advancements in brass instrument construction took place beginning at the end of the 19th century, when conical instruments such as the cornet and euphonium began replacing the more cylindrical instruments of the trumpet family. The newer instruments were often constructed with leadpipes that enhanced the instrument's tone and dynamic capabilities by extending the already tapered or elliptical backbore of the mouthpiece. The leadpipes were configured either as straight tapered leadpipes or as elliptically tapered leadpipes.

The shape of the leadpipe influence the quality of the sound produced when playing the instrument. Leadpipes with a straight taper produce a sound that can be described as more compact but more intense than the sound from an elliptical leadpipe. In contrast, leadpipes with elliptical configurations have more resonance, creating a fuller sound.

Over time, the elliptical leadpipe has become the preferred leadpipe configuration used in trombones, and is used on most other brass instruments as well. A drawback of the elliptical leadpipe is that it is less efficient than the straight taper leadpipe, thereby requiring more effort to play than a leadpipe with a straight taper.

Although many brass instruments have permanently fixed leadpipes, interchangeable leadpipes may be used on trombones, especially professional trombones, to give the player more sound-producing options. Interchangeable leadpipes in trombones may be soldered to a threaded collar affixed within a threaded receiver at the entrance of the first inner slide tube of the trombone.

The combination of a leadpipe and the backbore of a brass instrument functions as a waveguide after the sound passes through the mouthpiece, directing the energy of the sound wave from the leadpipe into the bore of the instrument. Existing leadpipes generally have one of two different configurations. The first is an elliptically tapered configuration downstream of the venturi. The second configuration is one in which the leadpipe has a straight taper downstream of the venturi.

Several improvements directed at improving the sound quality of brass instruments have been disclosed. Both U.S. Pat. No. 3,474,698 and U.S. Pat. No. 5,847,300 disclose devices that improve the sound of the instrument by minimizing the gap created when inserting a mouthpiece into the leadpipe of a brass instrument.

U.S. Pat. No. 6,087,572 discloses an adjustable receiver that allows players to adjust the relative position of the mouthpiece and leadpipe, thereby allowing some flexibility in the style of music produced.

U.S. Pat. No. 4,273,020 (the '020 patent) discloses a method to improve the sound of a brass instrument by creating a zone of increasing taper between the mouthpiece and valve section of the instrument, thereby improving the acoustic qualities of the instrument. The '020 patent discloses a leadpipe with a plurality of sections. The side of each section generally defines a frustum. Moving from the mouthpiece end of the leadpipe, the sides of each respective section increase in taper, resulting in a chromatic scale that is true to the desired pitch.

SUMMARY OF THE PRESENT INVENTION

A multi-tapered leadpipe for musical instruments incorporates a plurality of longitudinally extending sections. At least two of the plurality of sections has a taper. Each section that is downstream from the first tapered section has a reduced taper from the section immediately upstream. The configuration of the leadpipe may improve sound characteristics and increase the efficiency of the sound propagating through the instrument. The multi-tapered leadpipe may be affixed to a mouthpiece that does not contain a backbore.

A connection is made between the mouthpiece and the leadpipe wherein there is a nominal internal gap between the mouthpiece and the leadpipe. The combination of mouthpiece and leadpipe presents a single venturi to the flow of air. This configuration allows greater intensity in the overtones produced by the instrument. The more intense overtones may result in improved sound quality.

DETAILED DESCRIPTION OF THE DRAWINGS

A leadpipe with a multiplicity of longitudinally extending sections, each section having a sidewall that defines a taper, may provide increased playability and improved sound quality in the instrument in which it is located. The multi-tapered leadpipe has multiple sound-wave-reflecting surfaces. This allows the multi-tapered leadpipe to combine the efficiency of a leadpipe having a straight taper with the increased resonance of a leadpipe having an elliptical taper. The result is greater resonance and intensity of overtones combined with an equal or greater amount of overtones.

Figure 1:
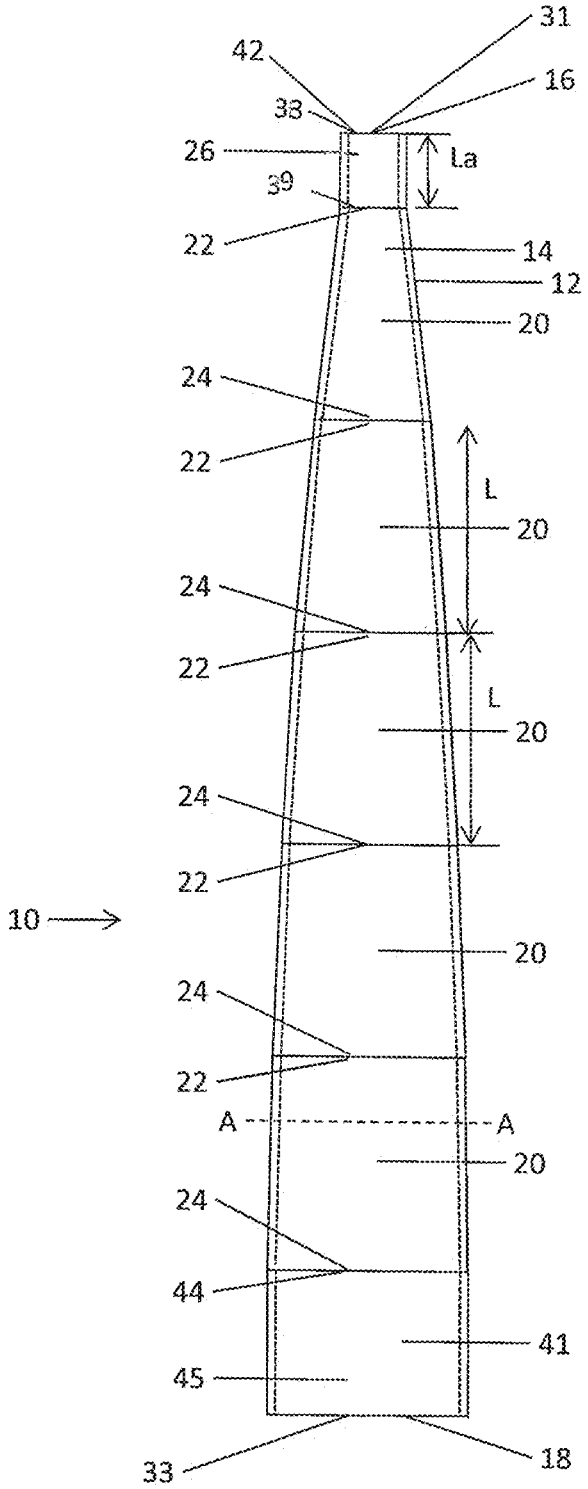
FIG. 1 is a side view of a multi-tapered leadpipe.
Figure 2:
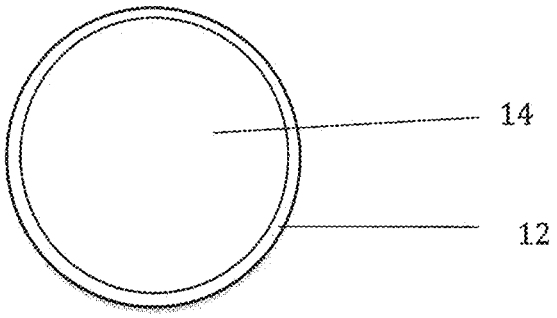
FIG. 2 is a cross-sectional view of the multi-tapered leadpipe of FIG. 1.

As shown in FIG. 1, the multi-tapered leadpipe 10 has a sidewall 12 defining an enclosed channel 14 having a first or upstream end 16, and a second or downstream end 18. The sidewall 12 has a generally annular cross-section, as shown in FIG. 2, with a first or upstream end that coincides with the first end of the enclosed channel 14, and a second or downstream end that coincides with the second end of the enclosed channel 14.

The sidewall 12 is comprised of a plurality of different longitudinally extending tapered sections 20 extending between the first end 16 and the second end 18 of the enclosed channel 14. Each tapered section 20 has a first or upstream end 22 and a second or downstream end 24. The first end 22 of each tapered section 20 has an inner diameter Df, and the second end 24 of each tapered section 20 has an inner diameter Ds. The inner diameter Ds at the second end 24 of each of the tapered sections 20 may differ from the inner diameter Ds of the second end 24 of at least one of the other tapered sections 20. The multi-tapered leadpipe will preferably have fewer than ten tapered sections 20.

In a plurality of the tapered sections 20, the inner diameter Df of the first end 22 of the tapered section 20 may be smaller than the inner diameter Ds of the second end 24 of the tapered section 20, thereby creating a taper in the tapered section 20. The portion of the sidewall 12 around each of the plurality of tapered sections 20 defines a generally frustoconical cavity.

The sidewall 12 may be comprised of nine or fewer tapered sections 20; particularly, of seven or fewer tapered sections 20, and more particularly, of six or fewer tapered sections 20.

In one arrangement, the portion of the sidewall 12 around the upstream-most section of the enclosed channel 14 may define a generally cylindrical portion 26 of the enclosed channel 14. The generally cylindrical portion 26 of the enclosed channel 14 may be upstream of the plurality of tapered sections 20. The generally cylindrical portion 26 of enclosed channel 14 may have a first or upstream end 38 and a second or downstream end 39. The inner diameter Df of the first end 38 of the generally cylindrical portion 26 of the enclosed channel 14 may be the same as the inner diameter Ds of the second end 39 of the generally cylindrical portion 26 of enclosed channel 14.

Figure 3:
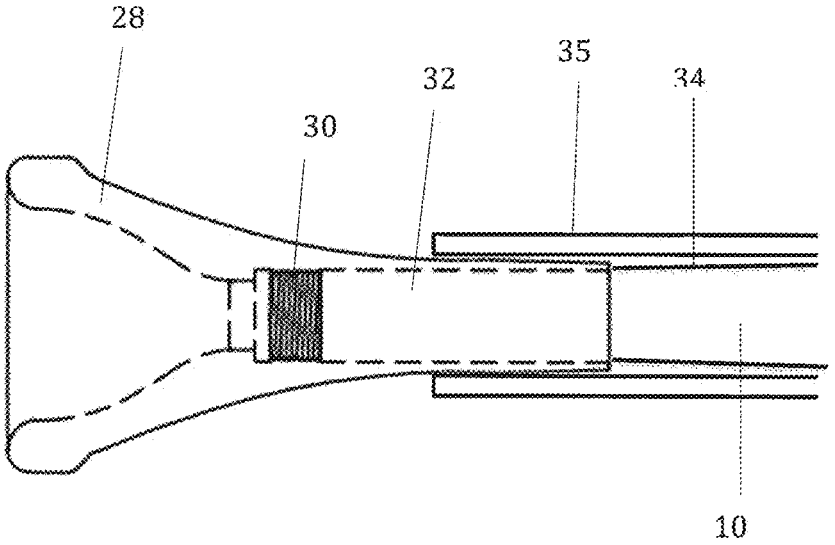
FIG. 3 is a side view of a portion of a multi-tapered leadpipe with a threaded sleeve, in position within an instrument.

The generally cylindrical portion 26 of enclosed channel 14 may be configured to enable the multi-tapered leadpipe 10 to be securable to the mouthpiece 28 of the instrument. The generally cylindrical portion 26 of enclosed channel 14 may be of a sufficient length to allow the multi-tapered leadpipe 10 to be secured to the mouthpiece 28 of the instrument at the generally cylindrical portion 26. The generally cylindrical portion 26 of enclosed channel 14 may have threads disposed on the outer surface of sidewall 12. The threads may be configured to mate with threads that may be disposed on the inner surface of the mouthpiece, thereby securing the multi-tapered leadpipe 10 to the mouthpiece 28, as shown in FIG. 3.

Alternatively, the multi-tapered leadpipe 10 may be secured to the mouthpiece 28 by press fit or other means. If the multi-tapered leadpipe 10 is to be secured within the mouthpiece 28 by a press-fit, the outer surface of the generally cylindrical portion 26 of enclosed channel 14 will be of a sufficient diameter to allow the first end of the leadpipe to be press-fit into the interior of the throat or venturi of the mouthpiece.

In another alternative arrangement, a sleeve 29 may be disposed on the generally cylindrical portion 26 of enclosed channel 14. The sleeve 29 may be secured to the portion of the sidewall 12 defining the generally annular portion 26 of the enclosed channel 14 by soldering, press fit, or other means. The sleeve 29 may be configured to be securable to the mouthpiece 28 of the instrument, specifically to the interior portion of the mouthpiece 28. The sleeve 29 may have threads on the outer surface. The sleeve 29 may be secured to the mouthpiece 28 by threads that mate with threads in the mouthpiece 28, by press fit, or by other means.

Alternatively, the downstream-most tapered section 20 of the leadpipe may be configured to secure the leadpipe to the instrument. The downstream end 33 of the multi-tapered leadpipe 10 may be press-fit into the bore of the instrument, and the mouthpiece 28 may be secured onto the sidewall 12 of generally cylindrical portion 26 of enclosed channel 14 or to sleeve 29 of the multi-tapered leadpipe.

The sidewall 12 may further define a second generally cylindrical section 41 following the final tapered section 20. The second generally cylindrical section 41 may be provided to provide mechanical strength to the unsupported end of multi-tapered leadpipe 10.

As shown in FIG. 3, the multi-tapered leadpipe 10 extends longitudinally from a mouthpiece 28 of an instrument 35. The first or upstream end 31 of the multi-tapered leadpipe 10 may be located within the bore 32 of the mouthpiece 28 when the multi-tapered leadpipe 10 may be disposed in the instrument. The second or downstream end 33 of the multi-tapered leadpipe 10 may extend into the interior of the bore 34 of the instrument.

Figure 4:
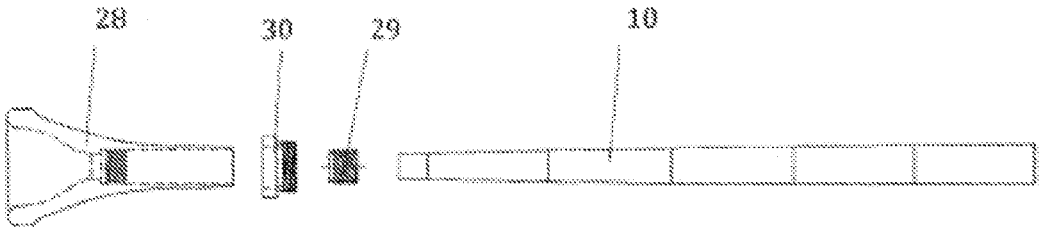
FIG. 4 is an exploded view of a multi-tapered leadpipe, threaded sleeve, threaded receiver and mouthpiece.
Figure 5:
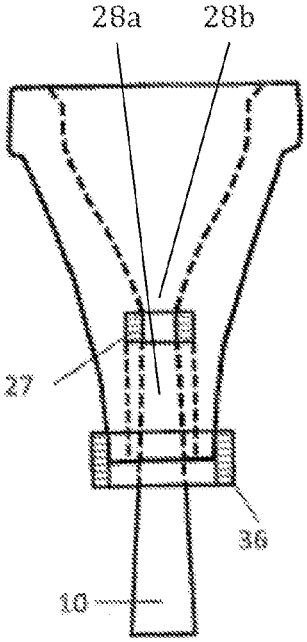
FIG. 5 is a side view of a multi-tapered leadpipe in position within an instrument and secured to a short mouthpiece.
Figure 6A:
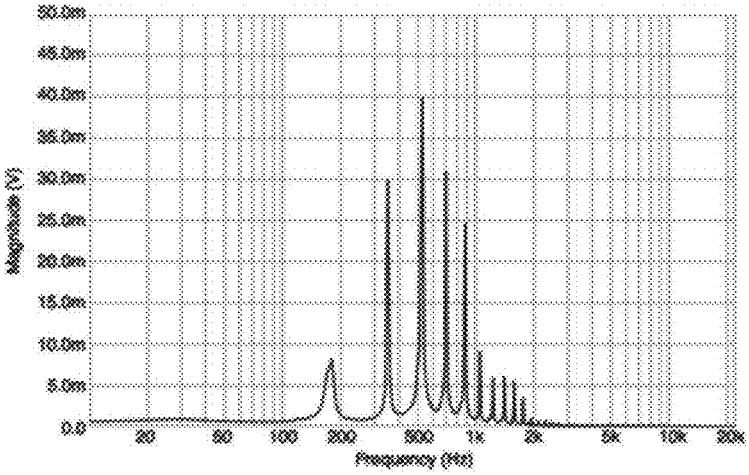
FIG. 6A is a graph showing the soundwaves produced using a conventional leadpipe on a bass trombone when playing an F-3 (174.61 Hz), with a decibel reading of −22.8 dB.
Figure 6B:
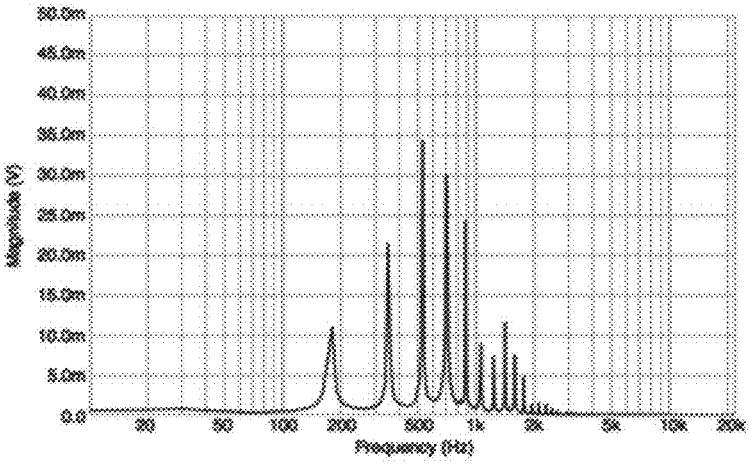
FIG. 6B is a graph showing the soundwaves produced using a multi-tapered leadpipe on a bass trombone when playing an F-3 (174.61 Hz) with a decibel reading of −23.7 dB.
Figure 7A:
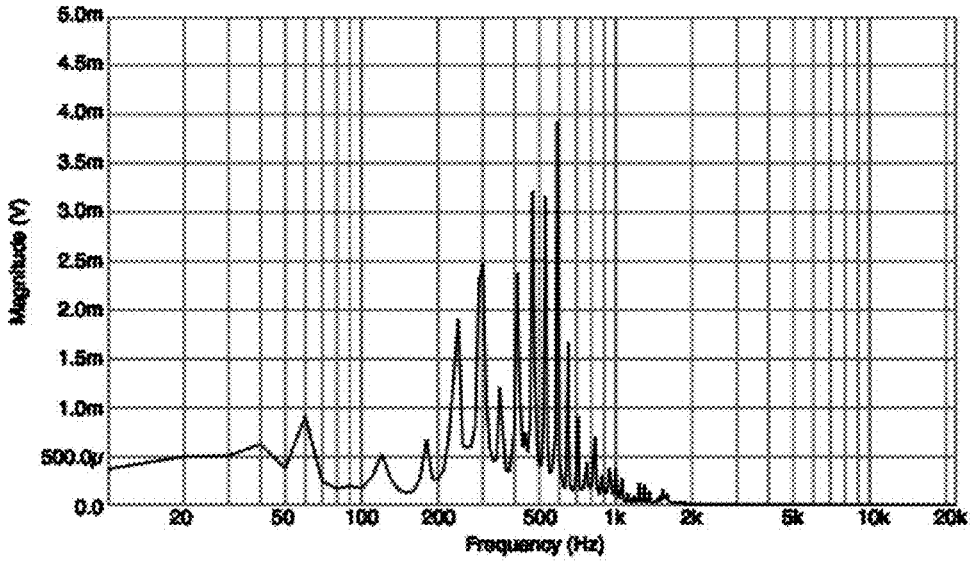
FIG. 7A is a graph showing the soundwaves produced using a conventional leadpipe on a tenor trombone when playing a Pedal B-flat (58.27 Hz) with a decibel reading of −41.4 dB.
Figure 7B:
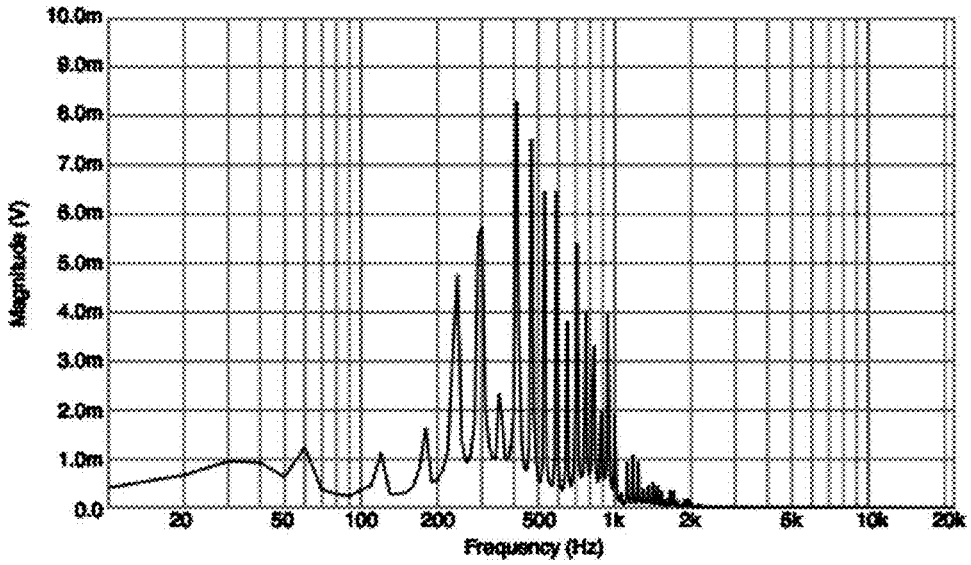
FIG. 7B is a graph showing the soundwaves produced using a multi-tapered leadpipe on a tenor trombone when playing a Pedal B-flat (58.27 Hz) with a decibel reading of −45.3 dB.
Figure 8A:
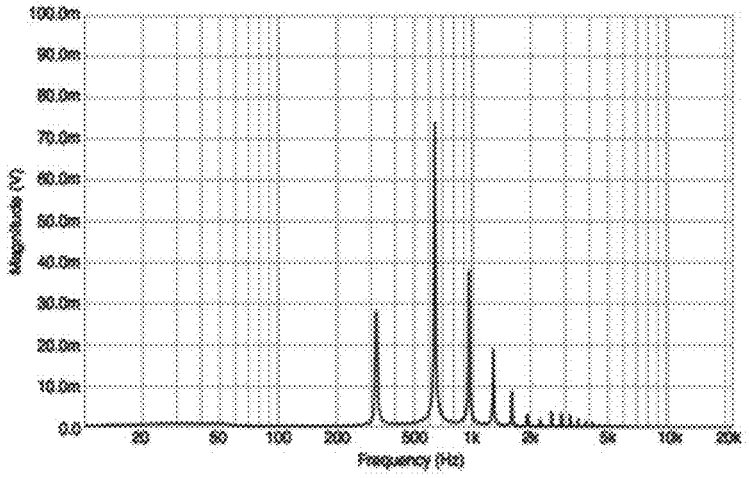
FIG. 8A is a graph showing the soundwaves produced using a conventional leadpipe on a tenor trombone when playing an E-flat-4 (311.13 Hz) with a decibel reading of −15.4 dB.
Figure 8B:
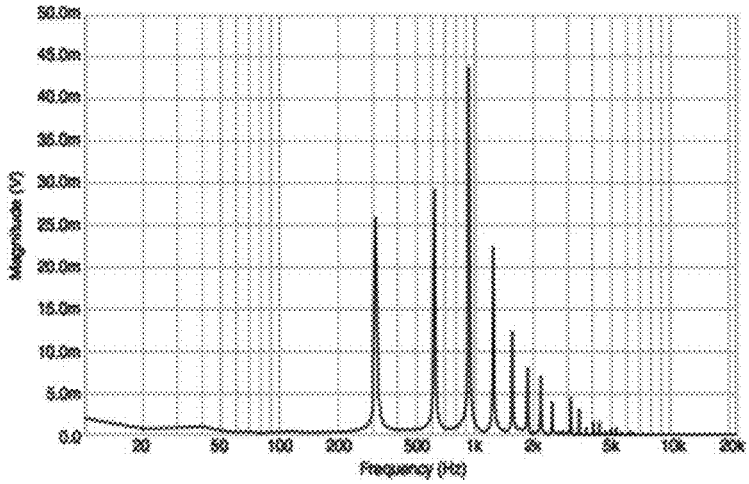
FIG. 8B is a graph showing the soundwaves produced using a multi-tapered leadpipe on a tenor trombone when playing an E-flat-4 (311.13 Hz) with a decibel reading of −15.5 dB.
Figure 9A:
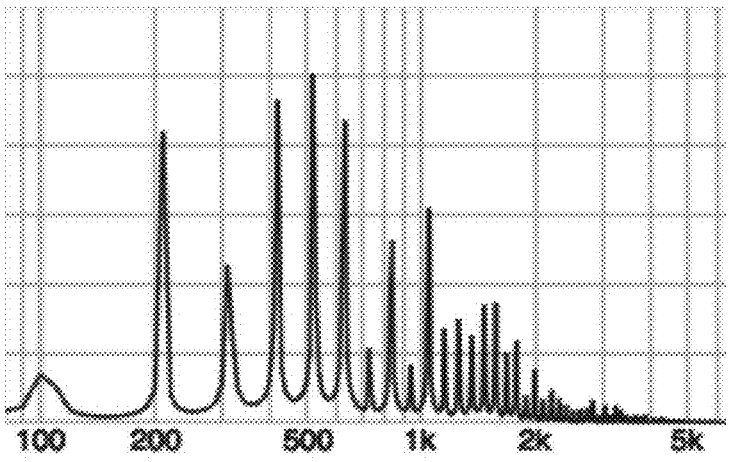
FIG. 9A is a graph showing the soundwaves produced using a conventional leadpipe on a tenor trombone when playing an A-flat-2 (103.83 Hz) with a decibel reading of −23.3 dB.
Figure 9B:
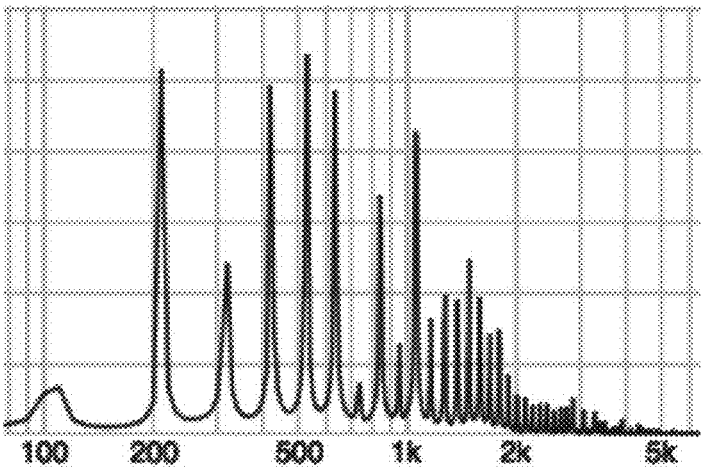
FIG. 9B is a graph showing the soundwaves produced using a multi-tapered leadpipe on a tenor trombone when playing an A-flat-2 (103.83 Hz) with a decibel reading of −23.6 dB.
Figure 10A:
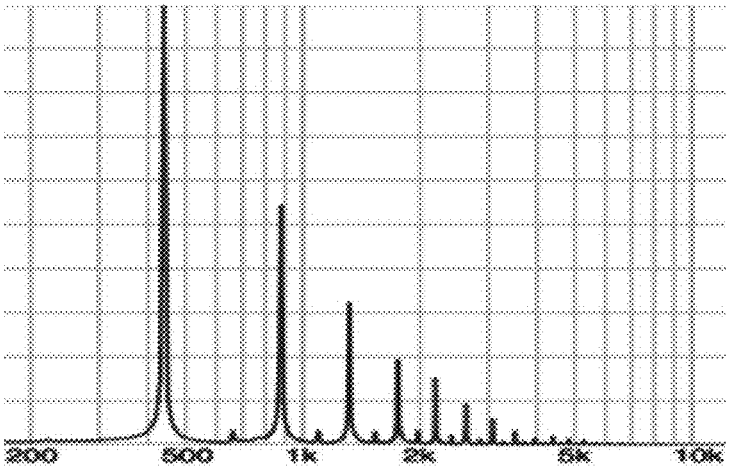
FIG. 10A is a graph showing the soundwaves produced using a conventional leadpipe on a tenor trombone when playing a A-4 (440.00 Hz) with a decibel reading of −14.4 dB.
Figure 10B:
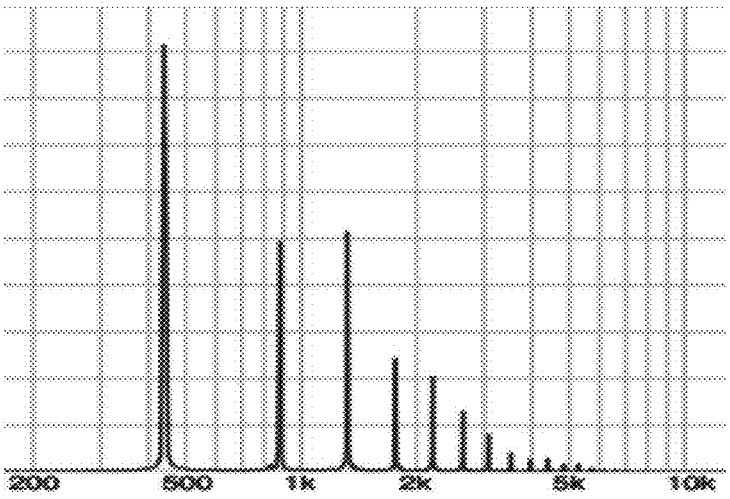
FIG. 10B is a graph showing the soundwaves produced using a multi-tapered leadpipe on a tenor trombone when playing a A4 (440.00 Hz) with a decibel reading of −15.3 dB.

Alternatively, a mouthpiece receiver 30 may be secured within the mouthpiece 28 to receive the sleeve 29 of the multi-tapered leadpipe 10 as shown in FIG. 4. The mouthpiece 28 used in this arrangement may be shorter than a traditional mouthpiece, and especially may have a shorter section downstream of the venturi, as shown in FIG. 5. As shown, the mouthpiece has no backbore. Instead, the first tapered section 20 of the multi-tapered leadpipe 10 functions as the backbore. The shortened mouthpiece of FIG. 5 may have a fitting 36 configured to secure the mouthpiece to the instrument. In a preferred embodiment, the mouthpiece 28 includes a throat portion 28*a* within the mouthpiece, and the cylindrical portion 26/connecting section has a length between 0.10 and 0.50 inches. The length of the throat portion 28*a* of the mouthpiece is between 0.10 and 2.00 inches. The total length of the connecting section and the throat portion of the mouthpiece is between 0.20 and 2.50 inches. More preferably, the length of the throat portion of the mouthpiece is between 0.10 and 0.50 inches, and the total length of the connecting section and the throat portion of the mouthpiece is between 0.25 and 0.75 inches. The mouthpiece defines a venturi 28*b* with a narrowest portion, and the cylindrical portion 26/connection section is secured at its end 42 to the mouthpiece 28 at the narrowest portion of the venturi 28*b* of the mouthpiece 28.

The inner diameter of the annular cross-section of the multi-tapered leadpipe 10 may vary over the length of the multi-tapered leadpipe 10. Within the length of each tapered section 20, the inner diameter of the annular cross-section of the multi-tapered leadpipe 10 may increase with increasing distances from the upstream end of the multi-tapered leadpipe 10.

In an alternative arrangement, a multi-tapered leadpipe 10 may be located in a pipe, such as an organ pipe, or may be configured to be used instead of a conventional organ pipe (not shown). When the leadpipe 10 is disposed within the organ pipe, the first end of the multi-tapered leadpipe 10 may be located in the mouth of the pipe. The multi-tapered leadpipe 10 may extend longitudinally from the mouth of the pipe into the body of the pipe. This arrangement may produce better sound from the organ pipe. If the instrument has a plurality of pipes, such as in an organ, a multi-tapered leadpipe 10 may be located in each of the pipes, extending from the mouth of the pipe into the interior of the body of the pipe. Alternatively, a plurality of multi-tapered leadpipes 10 may be used in place of the organ pipes.

As shown in FIG. 2, each of the plurality of tapered sections 20 extends along and defines a longitudinal portion of the length of the multi-tapered leadpipe 10. The plurality of longitudinally extending tapered sections 20 defined by the sidewall 12 of the multi-tapered leadpipe 10 each has a length L. A plurality of the tapered sections 20 may have the same length L as one another, or the lengths L may differ one from another. For most brass instruments, length L of each section may range from 0.5 to 3.0 inches, and in particular may range from 1.0 to 2.0 inches. However, for instruments with shorter bores, length L may be shorter than 0.5 inches, and for instruments with longer bores, length L may be longer than 3 inches.

Each tapered section 20 of multi-tapered leadpipe 10 has a first or upstream end 22 with an inner diameter Df and a second or downstream end 24 with an inner diameter Ds. The second end 24 of each tapered section 20 may have a larger inner diameter than the first end 22. Each tapered section 20 has a taper T, where the taper is the difference between the inner diameter Df of the first end 22 and the inner diameter Ds of the second end 24 per unit of length.

$$T = \frac{Ds - Df}{L} \tag{1}$$

In arrangements in which there is a generally cylindrical portion 26 of enclosed channel 14 at the upstream end of the multi-tapered leadpipe 10, the generally cylindrical portion 26 of enclosed channel 14 serves as a connecting portion and may have a length La that is different from the length L of the tapered sections. Preferably the length La is less than the length of the first tapered section and wherein La is less than the length of each of the at least one subsequent sections. In this arrangement, the inner diameter of the first end 22 and the inner diameter of the second end 24 of the generally cylindrical portion 26 are the same. Consequently, there is no taper in the portion of sidewall 12 defining a generally cylindrical portion 26 of enclosed channel 14.

The sidewall 12 of the tapered section 20 immediately downstream of the generally cylindrical portion 26 of enclosed channel 14 may have a positive taper. Each subsequent tapered section 20 of sidewall 12 will have a taper T that is less than the taper of the tapered section 20 disposed immediately upstream of it.

Each tapered section 20 that is located downstream of another tapered section 20 has a smaller taper than the section immediately upstream of it. A second generally cylindrical section 41 with no taper may be disposed downstream of the downstream-most tapered section 20 to provide mechanical strength to an unsupported end of multi-tapered leadpipe 10.

The multi-tapered leadpipe 10 is configured to be able to be secured to the inside of the mouthpiece 28 of the instrument 35. The multi-tapered leadpipe 10 eliminates a gap between the mouthpiece bore and the leadpipe, as the bore is integral to the rest of the leadpipe. Though there may now exist a nominal gap in the throat or venturi of the mouthpiece, the sound is not affected, both because of the venturi affect and because the gap occurs in a straight section.

The generally cylindrical section of the multi-tapered leadpipe 10 defined by the generally annular portion of sidewall 12 may be secured to the mouthpiece of the instrument. The generally cylindrical section of the multi-tapered leadpipe 10 defined by the generally cylindrical portion 26 of enclosed channel 14 may have threads 27 on the outer diameter of the sidewall 12. The multi-tapered leadpipe 10 may be secured to the mouthpiece by threads, by a press fit, or by any other conventional means.

It should be recognized that leadpipes have two basic configurations: one in which the leadpipe is permanently fixed to the instrument, as with a trumpet; and a second in which the leadpipe is detachable from the instrument, as with a trombone. In the case of the permanently fixed leadpipe as in a trumpet, the leadpipe may be external to the instrument, and may be disposed between the mouthpiece and the next joint of the instrument. Where the leadpipe is external, the sidewall 12 at the downstream end of the multi-tapered leadpipe 10 may be up to 0.25 inches thick.

In the case of the detachable leadpipe, the outer diameter of the leadpipe will have an external diameter sufficiently smaller than the instrument bore to allow the insertion of the leadpipe into the bore. In this configuration, the outer diameter of the downstream end 44 of the multi-tapered leadpipe 10 may be nearly the same as the inner diameter of the bore of the instrument. Where the multi-tapered leadpipe is designed to be disposed within the bore of an instrument, the sidewall 12 at the downstream end 44 of the multi-tapered leadpipe 10 may be between 0.003 and 0.030 inches thick. In particular, the sidewall may be between 0.006 and 0.014 inches thick. Thus, the inner diameter 45 of the downstream end 44 of the multi-tapered leadpipe 10 may be nearly the same length as the inner diameter of the bore of the instrument.

In another alternative embodiment, the leadpipe is configured to be used as an organ pipe. In this embodiment, the sidewall at the downstream end of the multi-tapered leadpipe may be up to 0.25 inches thick.

To construct the multi-tapered leadpipe 10, an internal bore of the mouthpiece may be calculated. The generally cylindrical section of the multi-tapered leadpipe 10 defined by the generally cylindrical portion 26 of enclosed channel 14 may have no taper. The generally cylindrical section of the multi-tapered leadpipe 10 may define a cylindrical shape of a sufficient length to allow the generally cylindrical section of the multi-tapered leadpipe 10 to secure the multi-tapered leadpipe 10 to the mouthpiece of the instrument. The generally cylindrical portion may have an inner diameter similar to the inner diameter of the internal bore of the mouthpiece at the point of attachment between the multi-tapered leadpipe 10 and the mouthpiece.

The upstream-most tapered section 20 of the multi-tapered leadpipe 10 may have an upstream inner diameter similar to the diameter of the internal bore of the mouthpiece. The upstream-most tapered section 20 will have an inner diameter at the second end that is larger than the inner diameter at the first section of the section.

Each subsequent tapered section 20 will have an inner diameter at the upstream end 22 that is the same as the inner diameter of the downstream end 24 of the tapered section 20 located immediately upstream of it, and an inner diameter at the downstream end 24 that is larger than the inner diameter at the upstream end 22 of the tapered section 20. However, the taper of each subsequent tapered section 20, as defined in equation (1) above, will be less than the taper of the tapered section 20 immediately upstream. The downstream end 24 of the tapered section 20 that is located furthest downstream from the mouthpiece may have an inner diameter that is less than 0.019 inch smaller than the inner diameter of the bore of the instrument, and may be as little as 0.008 inch smaller than the inner diameter of the bore of the instrument.

It should be apparent that many different methods may be used to create a set of tapers with decreasing slopes.

The longitudinally extending sections may be of uniform or of varying lengths. The sections should not be so short as to destroy the effects of the described tapers nor so long as to interfere with or not fit within the bore of the instrument.

The thickness and material of the multi-tapered leadpipe 10 should be sufficiently thick and sturdy to withstand handling. In the case of trombones, the thickness should not be so great as to create a large differential in diameters between the inner diameter of the downstream end 33 of the multi-tapered leadpipe 10 and the bore 34 of the instrument.

The multi-tapered leadpipe 10 relieves pressure gradually along the full length of the leadpipe, and uses a design with decreasing taper slope(s). The multi-tapered leadpipe 10 may affect the complete playing range of the instrument.

The multi-tapered leadpipe 10 may have several discrete tapered sections or as few as two, each with a different taper. The tapers may follow a mathematical projection. It is also recognized that brass instruments have different tube diameters such that the multi-tapered leadpipe 10 can be configured to produce the desired effects, but will have diameter, taper and length characteristics produced for that particular instrument.

Multi-tapered leadpipes of various configurations may be manufactured using an electro-forming process, wherein a sacrificial aluminum mandrel is machined to the desired taper. Various metals including copper, silver and nickel may be deposited on the mandrel until the desired thickness is reached. The mandrel may be subsequently dissolved away, leaving the leadpipe. A threaded sleeve may be soldered to the narrow end of the leadpipe. A mouthpiece may be machined to accept the sleeve/leadpipe assembly, forming a first assembly which may be inserted into the bore of the instrument and secured to the instrument. The electro-forming process may be simply an expedient method to be used to form the multi-tapered leadpipes 10. Any manufacturing method that can produce the required taper could be used including swaging, drawing, machining, investment casting, spin casting, powder metallurgy or moulding. In addition any material or combination of materials can be used to form the multi-tapered leadpipes 10 including metals, alloys, composites, plastics, glass or ceramics.

The multi-tapered leadpipes may be made of two electro deposited metals. The first layer may be electro deposited copper. A layer of nickel may be deposited on a longitudinally extending portion of the copper multi-tapered leadpipe. The nickel layer may function as a means of preventing the upstream section of the pipe from losing its concentricity when heat is applied during the soldering process for the application of the threaded sleeve. The downstream section of the pipe may be masked so that the nickel covers between approximately one half and two-thirds of the upstream section of the pipe. The multi-tapered leadpipe may alternatively be manufactured with only one layer of electrodeposited metal.

In one embodiment for a trombone, the mouthpiece and multi-tapered leadpipe assembly form a single convergent-divergent nozzle or venturi. The mouthpiece 28 formed the convergent section while the multi-tapered leadpipe 10 formed the divergent section of the venturi.

EXAMPLE

The configuration of a multi-tapered leadpipe was generated by determining a bore size for the mouthpiece, and using that as the inner diameter of the first end of the first tapered section. In the example shown in Table 1 below, the inner diameter, or bore, of the mouthpiece was determined by multiplying the instrument bore by 0.618, resulting in a mouthpiece bore of 0.3380.

The length of each tapered section was fixed at 1.618 inches. This resulted in tapered sections that have slopes that decrease by a rate related to the 0.618 value. However, the multiplier used to determine the initial taper may range from 0.50 to 0.70 and still fall within this description. The taper of the first tapered section was desired to be near 0.05, as that would yield a leadpipe of an appropriate length. An initial taper of 0.0493 was chosen.

An initial ID difference, (Ds−Df), between the upstream inner diameter and the downstream inner diameter of 0.0798 was used in the example. This ID difference was chosen as it would not result in too rapid an expansion and a leadpipe with a short length, or too slow an expansion and a leadpipe with too long a length.

The inner diameter D2 of the second end 24 of the first tapered section 20 may be determined by adding the ID difference to the calculated mouthpiece bore. In the example, the 0.0798 ID difference was added to the 0.3380 mouthpiece bore, resulting in an inner diameter at the second end of the first section of 0.4178 inches. This results in the portion of the sidewall 12 that extends between the upstream end 22 and the downstream end 24 of the first tapered section 20 generally defining a frustoconical cavity.

The inner diameter D3 for the second end of the section immediately downstream of the initial section may be determined by multiplying D2 by 1.618. This results in the portion of the sidewall 12 that extends between the upstream end 22 and the downstream end 24 of the second tapered section 20 generally defining a frustoconical cavity.

This calculation may be iteratively performed until the inner diameter of a tapered section nearly matches the inner diameter of the instrument bore. Thus, each tapered section 20 of the multi-tapered leadpipe 10 will have a taper that is less than the taper of the section immediately upstream. In the case of an external leadpipe, such as for a trumpet, the inner diameter of the downstream end of the multi-tapered leadpipe may be substantially the same as the inner diameter of the bore of the instrument.

Although the example uses 1.618 as the multiplier, other numbers could be used as the multiplier, particularly numbers ranging from 1.5 to 1.7.

Table 1 below illustrates the dimensions of the tapered sections starting with an instrument bore of 0.547 inches and an initial mouthpiece bore of 0.338 inches. In order to achieve a suitable slope set, a starting ID difference, (Ds−Df), of 0.0798 was used. The starting ID difference may range from 0.10 to 0.04 and still fall within this description. Using a larger starting ID difference may result in a more rapid expansion of the leadpipe, fewer tapered sections, and a shorter length, while using a smaller starting ID difference may result in a slower expansion requiring more tapered sections and a longer multi-tapered leadpipe. Leadpipes that are too long may not fit within the instrument, while leadpipes that are too short may not produce a change in the quality of the sound.

The diameter Dn of the second end of one of the subsequent tapered sections can be expressed as:

$$Dn = \frac{[Ds - Df]}{L} + Ds \tag{2}$$

where Df is the diameter of the first end of the tapered section, Ds is the first end of the tapered section immediately upstream, and L is the length of the tapered section. The taper T can be expressed as:

$$T = \frac{[Ds - Df]}{L} \tag{3}$$

where the difference in inner diameters, (Ds−Df) is referred to as the ID difference. The diameters and tapers calculated are shown in the table below.

TABLE 1

| Diameter of first end of section | Diameter of second end of section | (Ds − Df) | Taper |
|---|---|---|---|
| 0.3380 | 0.4178 | 0.0798 | .0493 |
| 0.4178 | 0.4671 | 0.0492 | .0305 |
| 0.4671 | 0.4976 | 0.0305 | 0.0188 |
| 0.4975 | 0.5163 | 0.0188 | 0.0116 |
| 0.5163 | 0.5279 | 0.0116 | 0.0072 |
| 0.5279 | 0.5351 | 0.0072 | 0.0044 |

In this example, the first end of the first tapered section of the multi-tapered leadpipe 10 has an inner diameter of 0.338 inch and the tapered section has a length of 1.618 inches. The second end of the first tapered section in the example has an inner diameter of 0.4178 inch. This diameter gives an initial taper that will result in a multi-tapered leadpipe with six tapered sections. The initial taper is calculated to be 0.0493 inches/inch. The first end of a tapered section has the same inner diameter as the second end of the tapered section immediately upstream. Thus, the taper is added to the inner diameter of the first end of the section immediately upstream to obtain the inner diameter of the second end of the subsequent tapered section. In the example, the taper is added to the inner diameter of the second end of the first tapered section to get the diameter of the second end of the second tapered section. Since the second end of the first tapered section coincides with and has the same diameter as the first end of the second tapered section, the identical result can be obtained by adding the taper to the inner diameter of the first end of the tapered section. This calculation may be made iteratively until the desired end diameter is reached. In the example, the desired maximum end diameter is 0.5351 inches, based on the inner diameter of the bore of the instrument. In this case, a leadpipe having an inner diameter of 0.5351 inches would have to have a wall thickness of less than 0.006 inches if an interchangeable leadpipe is desired. A wall thickness of 0.006 inches and an inner diameter of 0.5351 inches would require that the leadpipe be press-fit into the bore of the instrument. The multi-tapered leadpipe may have six tapered sections with an inner diameter at the downstream of 0.5351 inches. Further, the multi-tapered leadpipe may be press-fit into the bore of the instrument or, alternatively, the leadpipe may have five tapered sections and an inner diameter at the downstream end of 0.5279 inches.

A mouthpiece with a smaller bore may change the playing characteristics of the instrument. In this case, multiplying the calculated mouthpiece bore diameter by 0.618 yields a new mouthpiece bore size of 0.2089. The resulting multi-tapered leadpipe 10 would require an extra tapered section to approach the 0.535 inch end diameter of the example.

In some cases where a player may prefer to play an instrument without a leadpipe, very short tapered sections may provide improved sound quality with minimal increase to backpressure that may be experienced by the player.

Construction of several multi-tapered leadpipe and mouthpiece assemblies enabled live performance and comparison with existing products. The performance of multi-tapered leadpipes of varying geometries and sizes was tested in a study. The study compared the multi-tapered leadpipe to a conventional leadpipe using Fast Fourier Transform (FFT) graph to plot the differences.

The graphical results that are shown in FIGS. 6-10 indicate that the present invention responds with overtones of greater intensity than those of conventional leadpipes. In the trial players performed on an instrument fitted alternately with a multi-tapered leadpipe 10 and a conventional leadpipe. The mouthpieces used with the multi-tapered leadpipe were adapted for the study. There were five different multi-tapered leadpipe/mouthpiece assemblies with varying rim sizes, and five conventional mouthpieces of varying rim sizes for the participants to choose from. This allowed the participants to perform on a rim size similar to the rim size they were accustomed to using.

The graphs in FIGS. 6-10 show soundwaves produced by several different trombonists. Each pair of graphs represents a different note. For example, FIG. 6A shows the soundwaves produced when a player played an F-3 on a bass trombone fitted with a conventional leadpipe, while FIG. 6B shows the soundwaves produced when a player played an F-3 on a bass trombone fitted with a multi-tapered leadpipe. The number after the note represents the octave of the pitch, as it relates to its order on a keyboard instrument.

Each note represented in each pair of figures was taken from a different player. Each player in the study performed their note on a modified mouthpiece with a multi-tapered leadpipe, and on a conventional mouthpiece with a conventional elliptical leadpipe. The decibel readings for each note are also given for each graph. The graphs showing soundwaves from the conventional leadpipes are from notes that are slightly louder than the notes from the multi-tapered leadpipes. Thus, the increases in soundwave magnitude seen in the graphs from the multi-tapered leadpipes compared to the notes played with a conventional leadpipe are not due to differences in volume. (Note: the graphs do not show exactly the same decibel readings as it is difficult to get musicians to play the notes at exactly the same volume, so graphs from one note played by one musician on different leadpipes were matched as closely as possible for volume levels.)

As shown in FIGS. 6-10, the overtones are more intense when the participants played their notes with the multi-tapered leadpipe, compared to those notes played using a conventional elliptical leadpipe. The difference is most noticeable in the frequencies between 1 kHz and 5 kHz, and especially in the frequencies between 1 kHz and 2 kHz. The differences in magnitude of the soundwaves produced may be because the multi-tapered leadpipe 10 is a more efficient waveguide and preserves more of the overtones generated by the musician.

With regard to the processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

It is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It should be understood that the invention is capable of modification and variation and is limited only by the following claims. All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A leadpipe comprising:

a sidewall defining an enclosed channel, the sidewall having an upstream end and a downstream end;

wherein the sidewall is comprised of a plurality of sections including a first tapered section upstream of at least one subsequent section;

wherein each of the sections extends longitudinally between the upstream end of the sidewall and the downstream end of the sidewall;

wherein the first tapered section is disposed upstream of the at least one subsequent sections;

wherein the first tapered section and at least one subsequent section of the sidewall each define a generally frustoconical cavity having an upstream end with an upstream inner diameter Df and a downstream end with a downstream inner diameter Ds;

wherein the downstream inner diameter of each of the sections is larger than the upstream inner diameter; and wherein each of the sections has a length L and a taper T, wherein the taper is defined as T=(Ds−Df)/L, wherein the taper of the first tapered section is larger than the taper of each of the subsequent sections, and wherein the taper of each of the subsequent sections is less than the taper of the section immediately upstream.

2. The leadpipe of claim 1, wherein the length of the first tapered section is the same as the length of at least one of the subsequent sections.

3. The leadpipe of claim 1, wherein the length of the first tapered section is the same as the length of each of the subsequent sections.

4. The leadpipe of claim 1, further comprising a generally annular section, wherein the generally annular section is located downstream of all of the subsequent sections.

5. The leadpipe of claim 1, wherein the length L of the first tapered section and each of the subsequent sections is between 0.5 inch and 3.0 inches.

6. The leadpipe of claim 1, wherein the taper of the first tapered section is between 0.10 and 0.04.

7. The leadpipe of claim 1, wherein the number of subsequent sections is between one and eight.

8. The leadpipe of claim 1, wherein the downstream inner diameter of each of the subsequent sections is defined as ((Ds−Df)/L)+Ds where Ds, Df, and L are measured in the section immediately upstream of each of the subsequent sections.

9. The leadpipe of claim 8, wherein the upstream inner diameter of each of the subsequent sections is the same as the downstream inner diameter of the section immediately upstream.

10. The leadpipe of claim 1, wherein the sidewall further comprises a connecting section, wherein the connecting section is located upstream of the first tapered section, and wherein the connecting section of the sidewall generally defines a cylinder.

11. The leadpipe of claim 10, wherein the connecting section has a length La, wherein La is less than the length of the first tapered section and wherein La is less than the length of each of the at least one subsequent sections.

12. The mouthpiece of claim 10, wherein the connecting section has a length, and wherein the length of the connecting section is between 0.10 and 0.50 inches.

13. The leadpipe of claim 10, further comprising a threaded sleeve, wherein the threaded sleeve is secured to the connecting section.

14. The leadpipe of claim 13, further comprising a mouthpiece, wherein the mouthpiece has a bore, wherein the bore of the mouthpiece has a threaded portion, wherein the threaded portion is configured to accept the threaded sleeve.

15. The leadpipe of claim 14, wherein the first tapered section is configured to function as a backbore of the mouthpiece.

16. The leadpipe of claim 14, wherein the mouthpiece has a bore having an inner diameter, and wherein the upstream inner diameter of the first tapered section is substantially the same as the inner diameter of the bore of the mouthpiece.

17. The leadpipe of claim 14, further comprising a throat portion within the mouthpiece, wherein the connecting section has a length, wherein the length of the connecting section is between 0.10 and 0.50 inches, wherein the length of the throat portion of the mouthpiece is between 0.10 and 2.00 inches, and wherein the total length of the connecting section and the throat portion of the mouthpiece is between 0.20 and 2.50 inches.

18. The leadpipe of claim 17, wherein the length of the throat portion of the mouthpiece is between 0.10 and 0.50 inches, and wherein the total length of the connecting section and the throat portion of the mouthpiece is between 0.25 and 0.75 inches.

19. The leadpipe of claim 17, wherein the mouthpiece has a venturi, wherein the venturi has a narrowest portion, and wherein the connecting section is secured to the mouthpiece at the narrowest portion of the venturi of the mouthpiece.

* * * * *